United States Patent [19]

Weinstein

[11] Patent Number: 4,971,203

[45] Date of Patent: Nov. 20, 1990

[54] CHILD-RESISTANT PILL DISPENSER

[75] Inventor: Jack Weinstein, Manchester Township, Ocean County, N.J.

[73] Assignee: Primary Delivery Systems, Inc., Annandale, N.J.

[21] Appl. No.: 457,154

[22] Filed: Dec. 26, 1989

[51] Int. Cl.[5] ..... B65D 83/04; B65D 85/56

[52] U.S. Cl. ..... 206/536; 206/807; 215/223; 222/519; 222/524

[58] Field of Search ..... 206/528, 535, 536, 537, 206/807; 215/223; 222/153, 519, 524, 549; 221/154

[56] References Cited

U.S. PATENT DOCUMENTS

| | | | |
|---|---|---|---|
| 781,527 | 1/1905 | Jeffers, Jr. | 206/536 |
| 2,353,629 | 7/1944 | Apfelbaum | 206/536 |
| 3,627,160 | 12/1971 | Horvath | 215/223 |
| 3,749,270 | 7/1973 | Affleck | 215/223 X |
| 3,762,539 | 10/1973 | Kerr | 206/537 |
| 4,234,093 | 11/1980 | Tyson | 206/536 |
| 4,524,876 | 6/1985 | Kusz | 215/223 X |

*Primary Examiner*—Paul T. Sewell

*Assistant Examiner*—Jacob K. Ackun, Jr.

*Attorney, Agent, or Firm*—Kenneth P. Glynn

[57] ABSTRACT

The present invention is directed to a childproof dispenser for dispensing pills to similar articles which involves an elongated tubular body and a cap member telescopically connected therewith. Both the elongated tubular body and the cap member contain dispensing orifices which are not aligned horizontally and need not be aligned vertically in the closed position. Either the cap member or the elongated tubular body contains a horizontal track and a vertical track and the other contains a protrusion which travels in the track. The cap member may be inserted into the elongated tubular body wherein the protrusion and the track fit to one another or, in an alternative embodiment, the cap member may be fitted into the elongated tubular body. In order to dispense pills or like articles, the user must rotate the cap member relative to the elongated tubular body along the horizontal track and pull upwardly so that the protrusion engages with the vertical track so as to ultimately align the elongated tubular body orifice and the cap member orifice for dispensing.

4 Claims, 2 Drawing Sheets

CHILD-RESISTANT PILL DISPENSER

BACKGROUND OF THE INVENTION

1. Field of the Invention

The present invention is directed to a child resistant dispenser for pills or similar articles and more particularly for a portable dispenser which is both child resistant and convenient to the user. It involves the use of a telescoping cap member and elongated tubular body with orifices which are not aligned when the dispenser is closed and which requires relative horizontal movement and then telescoping or vertical movement to achieve alignment of the cap and the body orifices for dispensing.

2. Prior Art Statement

The use of dispensers with openings in a cap and a main body which must be aligned to achieve dispensing or with cap openings which telescope relative to main bodies of dispensers in order to open a dispensing orifice are well known. Thus, U.S. Pat. No. 2,256,257 to Dukehart, issued in 1941 shows a basically tubular structure with a solid cap which has a first, closed position wherein a dispensing orifice is blocked off by the wall of the tube itself and a telescoping upward, second position whereby the orifice in the cap is opened to the top of the tube so as to permit dispensing. In 1944, U.S. Pat. No. 2,352,066 issued to Apfelbaum for a dispensing container which includes a tubular member and a cap with an orifice wherein the tubular member includes an orifice at its top and the cap member has an orifice which can only be aligned by horizontal rotation of the cap relative to the body.

In 1969, U.S. Pat. No. 3,471,056 was issued to Kovac which describes an article dispenser with a reciprocating injector. A telescoping bottom/top arrangement permitted an opened and closed position for ejecting individual pills by pressing one side of the container so as to eject the pill out of a slot on the other side of the container. A pill dispenser patent was issued in 1973 to Glenn Kerr as U.S. Pat. No. 3,762,539. This patent describes a pill dispenser which has a plastic tube with a cap which has a spring biasing means and a twist and lock mechanism. The orifices in the tube and the cap are superimposed to dispense pills in a single twist and lock position and are separated so as to close off the orifices and retain the pills in a second position. Basically, a J type channel is used in conjunction with a protrusion so that there is a single resting position at the bottom tip of the J for a closed dispenser and a second position at the upper part of the beginning of the J for a dispensing position. This patent teaches the use of a spring so that if a child were to inadvertantly rotate the cap along the base of the J the spring would automatically open up the pill dispenser by virtue of automatic vertical alignment of the orifices in the cap and in the tube.

U.S. Pat. No. 4,154,365 describes a dispensing container which involves the use of two containers or receptacles, one within the other with each having an opening in its walls and arranged such that the openings are aligned by vertical movement of an outer and inner tube. In one embodiment, a childproof slip ring (FIG. 18) is included which requires alignment of the ring along with alignment of the two dispensing tubes to enable the user to actually dispense a pill.

U.S. Pat. No. 4,784,288 describes an article dispenser with tamper evident means and this patent describes rather complex mechanisms for indicating whether or not the container has been tampered with. The container itself typically involves the use of a tubular body and a cap with an orifice which, in its downward position, must be aligned with an opening in the tube to effect dispensing. There is no childproof aspect to the teachings but rather the tamper proof arrangement consitutes the apparent point of novelty.

Notwithstanding the above cited prior art, it is believed that there is no teaching which discloses or renders obvious the present invention involving the use of a horizontal track and a vertical track so as to require horizontal alignment of a cap with a tube for subsequent vertical movement of the cap relative to the tube to open or align orifices in the cap and tube for subsequent dispensing.

SUMMARY OF THE INVENTION

The present invention is directed to a childproof dispenser for dispensing pills or similar articles which involves an elongated tubular body and a cap member telescopically connected therewith. Both the elongated tubular body and the cap member contain dispensing orifices which are not aligned horizontally and need not be aligned vertically in the closed position. Either the cap member or the elongated tubular body contains a horizontal track and a vertical track and the other contains a protrusion which travels in the track. The cap member may be inserted into the elongated tubular body wherein the protrusion and the track fit to one another or, in an alternative embodiment, the cap member may be fitted into the elongated tubular body. In order to dispense pills or like articles, the user must rotate the cap member relative to the elongated tubular body along the horizontal track and pull upwardly so that the protrusion engages with the vertical track so as to ultimately align the elongated tubular body orifice and the cap member orifice for dispensing.

BRIEF SUMMARY OF THE DRAWINGS

The present invention will be more fully understood when the specification herein is taken in conjunction with the drawings appended hereto, wherein.

DETAILED DESCRIPTION OF THE INVENTION AND DRAWINGS

Figure 1:
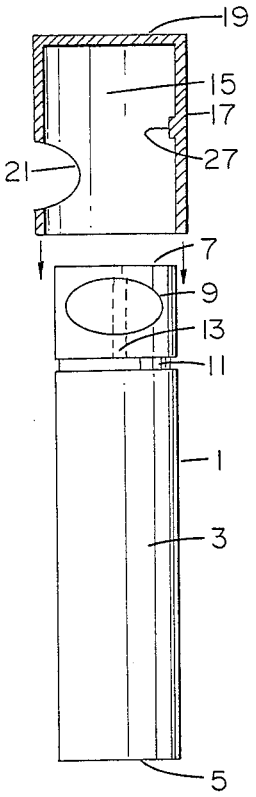
FIG. 1 illustrates an elongated tubular body, front view and a cut detached side view of a cap member of a childproof dispenser of the present invention.

Referring now specifically to FIG. 1 there is illustrated an elongated tubular body 1 for stacking pills or other articles for dispensing with enclosed walls 3 and a bottom 5 and an open top 7. Elongated tubular body 1 may have any cross sectional configuration and, in particular, circular, oval, square and rectangular are shapes which may be used for the dispensing of pills or other articles of similar shape such as square or elongated antacid tablets or oval vitamin pills or round aspirin. Elongated tubular body 1 includes a dispensing orifice 9 as shown. Additionally, formed into the side wall 3 of elongated tubular body 1 is horizontal track 11 connected to vertical track 13 shown on the back side by dotted lines.

Also shown in FIG. 1 is cap member 15 which includes side walls 17 and enclosed top 19 as well as cap dispensing orifice 21. Cap 15 also includes protrusion 27 and, when cap 15 is pushed down over side wall 3 of elongated tubular body 1, protrusion 27 pops into horizontal track 11. At this point, assuming that the elongated tubular body 1 has been filled with pills or other items for dispensing, the device shown operates such that protrusion 27 travels along horizontal track 11 by rotation of cap member 15 and elongated tubular body 1 relative to one another. Thus, vertical alignment, that is alignment of the cap dispensing orifice 21 and of the dispensing orifice 9 are only achieved when the two components are rotated relative to one another such that protrusion 27 sits in horizontal track 11 directly aligned with vertical track 13. At this point, the device may be pulled or telescoped for use as more fully described in conjunction with FIGS. 2 through 7 below.

Figure 2:
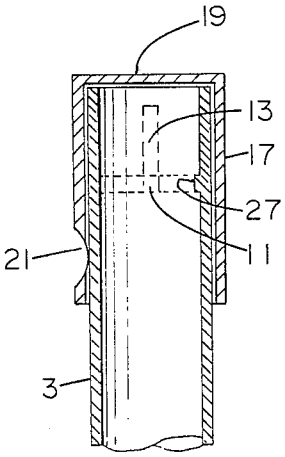
FIGS. 2 and 3 show a cut view and an uncut view of the elongated tubular body and cap member of FIG. 1 in the closed position with the two orifices totally unaligned.
Figure 3:
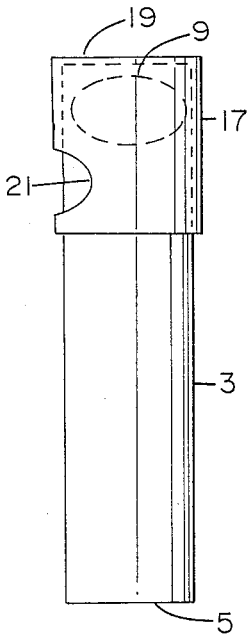

FIGS. 2 and 3 show a cut view and an uncut view of the elongated tubular body 1 of FIG. 1 and cap member 15 of FIG. 1 in the closed position with the two orifices 9 and 21 totally unaligned, that is, not aligned vertically and not aligned horizontally. As can be seen from FIG. 3, the solid portion of side wall 17 covers orifice 9 so as to prevent pills from dispensing therethrough. Likewise, concommitantly, the side wall 3 of elongated tubular body 1 blocks cap dispensing orifice 21.

Figure 4:
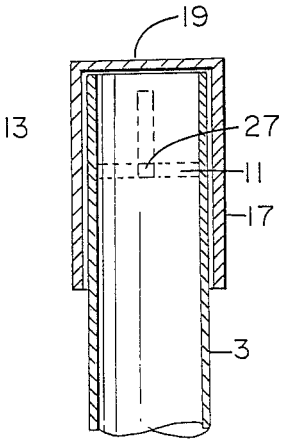
FIGS. 4 and 5 show a cut view and a full view of the elongated tubular body and cap member of FIG. 1 with the cap member rotated along the horizontal track so that the two orifices are aligned vertically but not horizontally.
Figure 5:
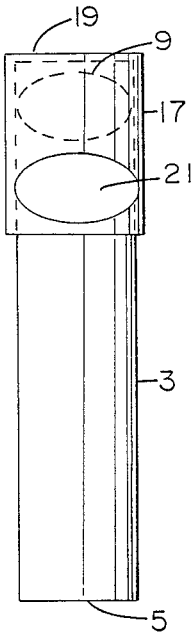

Referring now to FIGS. 4 and 5, there is shown a cut view and a full view of the elongated tubular body 1 and cap member 15 referred to above. Here, the user has rotated the two components relative to one another such that protrusion 27 has moved along horizontal track 11 and, with cap member 15 still in the down postion, protrusion 27 is aligned with vertical track 13 but not yet travelling in vertical track 13 above horizontal track 11.

Figure 6:
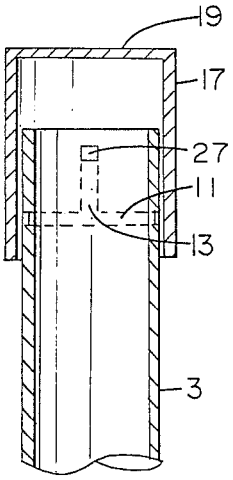
FIGS. 6 and 7 show a cut view and a full view of the dispenser of FIG. 1 with the cap member pulled up along the vertical track so that the two orifices are aligned both vertically and horizontally for pill dispensing.
Figure 7:
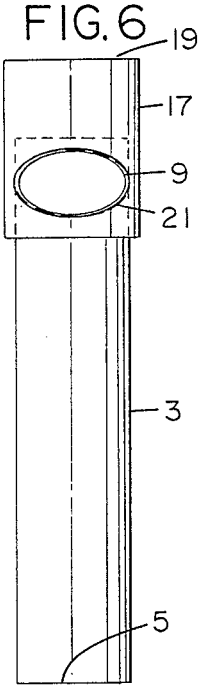

FIGS. 6 and 7 show a cut view and a full view of the dispenser of FIG. 1 with cap member 15 having been pulled up by the user along vertical track 13 such that cap dispensing orifice 21 and dispensing orifice 9 are now totally aligned, that is, both vertically and horizontally aligned.

Figure 8:
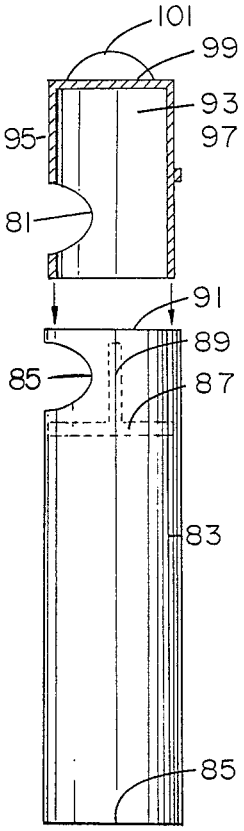
FIG. 8 shows a side view of an alternative embodiment elongated tubular body and a cut side view of a cap member therefor which is inserted into the elongated tubular body.

FIG. 8 illustrates an alternative embodiment of the present invention wherein elongated tubular body 83 with bottom 85 has dispensing orifice 86 and inside open top 91 has horizontal track 87 and vertical track 89. In this embodiment, cap member 93 with side wall 95 and cap dispensing orifice 81 is sized to be pushed into elongated tubular body 83, as shown. Thus, in this embodiment, cap member 93 has protrusion 97 on its outside. Optional key or rotating handle 101 is also included on the top 99 of cap member 93 so as to make rotation of the internally inserted cap member 93 easier for the user.

Figure 9:
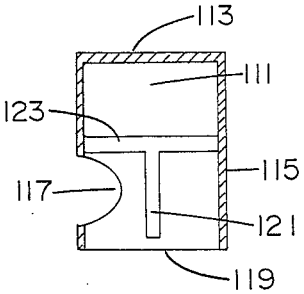
FIG. 9 illustrates a childproof dispenser of the present invention wherein the cap member contains the vertical and horizontal track.

FIG. 9 shows a childproof dispenser of the present invention wherein cap member 11 has top 113 and side wall 115. Cap dispensing orifice 117 is also included as well as opening 119. In this embodiment, vertical track 121 and horizontal track 123 are formed inside cap member 111 so that an elongated tubular body (not shown) with a protrusion may receive cap member 111. In other words, this would be very much like the product shown in FIG. 1 except that the tracks or grooves are now located in the cap and the protrusion is located on the elongated tubular body.

Figure 10:
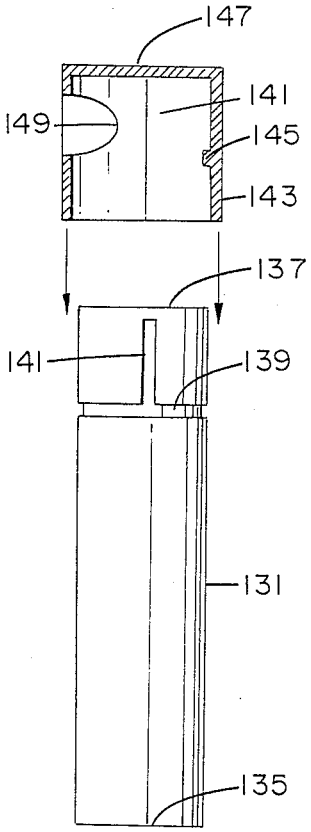
FIG. 10 shows an alternative embodiment wherein the elongated tubular body member utilizes as its orifice for dispensing the space above the open top which is created when the cap member is in the open position.

FIG. 10 shows another alternative embodiment wherein elongated tubular body 131 with bottom 135 has a horizontal track 139 and a vertical track 141 but has no dispensing orifice cut therein. Instead, the opening at 137 becomes the dispensing orifice. Specifically, cap member 141 with side wall 143 and top 147 has a protrusion 145 as shown as well as dispensing orifice 149. When cap member 141 is pushed down over elongated tubular body 131 by the arrows as shown in FIG. 10, and protrusion 145 now rides within horizontal track 139, dispensing orifice 149 is blocked by the upper portion of elongated tubular body 131. However, when cap member 141 is rotated horizontally and then pulled up with protrusion 145 following vertical track 141, dispensing orifice 149 is then located above top 137 of elongated tubular body 131. At this point, by merely tilting or tipping upside down the dispenser, the pill or other article is dispensed through now unlocked dispensing orifice 149.

It is not critical as to whether or not the elongated tubular body or the cap member contains the horizontal and vertical track or the protrusion, nor is it critical to the invention as to whether or not the cap is inserted into or attaches on the outside over the elongated tubular body. However, it is simpler to use and more efficient when the cap is on the outside of the elongated tubular body. The device it self may be made of plastic or metal or otherwise without exceeding the scope of the invention. Further, while a single protrusion and track is shown, more than one vertical track or horizontal track could be used without exceeding the scope of the invention. Thus, one could use two sets of protrusions which are not symetrically opposite one another and two sets of vertical tracks so that a double alignment would be necesssary for the dispensing unit to open. Likewise, the device has been shown in the figures in its most simplistic form but variations may be included without exceeding the scope such as the use of ejection cartridges, refillable cartridges or other complexities which may be integrally built into or retrofitted or put into the device for use. Likewise, the bottoms are shown to be solid but could be hinged or forced fit members to simplify single filling or to allow for refilling.

Obviously, numerous modifications and variations of the present invention are possible in light of the above teachings. It is therefore understood that within the scope of the appended claims, the invention may be practiced otherwise than as specifically described herein.

What is claimed is:

1. A childproof dispenser for dispensing pills or like articles one at a time, which comprises:

(a) an elongated tubular body for stacking pills or the like for dispensing, said elongated tubular body having enclosed walls and bottom and having an open top and a dispensing orifice located near said top; and, (b) a cap member having a top and walls and a dispensing orifice located in said walls, wherein said walls have the same cross sectional configuration as the walls of said elongated tubular body and wherein said cap member is telescopically engaged with said elongated tubular body;

wherein one of said elongated tubular body and said cap member contains a horizontal track which traverses at least a majority of the circumference of the elongated tubular body at one end of the elongated tubular body, and further includes a vertical track extending upwardly from said horizontal track, and, wherein the other of said elongated tubular body and said cap member contains a protrusion which rides within said track, so that when said elongated tubular body is moved horizontally relative to said cap member, the protrusion travels in said horizontal track and wherein relative telescopic motion between said elongated tubular body and said cap member may only be effected by movement thereof with said protrusion aligned with and then travelling in said vertical track, and further wherein both vertical and horizontal alignment of the dispensing orifice in said cap member and the dispensing orifice in said elongated tubular body are achieved when said protrusion is in an uppermost location of said vertical track.

2. The childproof dispenser of claim 1 wherein said horizontal track and said vertical track are located on the outside of said elongated tubular body and said protrusion is located on the inside of said cap member and said cap member telescopically interconnects with said elongated tubular body by being fitted over the outside of the top portion of said elongated tubular body.

3. The childproof dispenser of claim 1 wherein said vertical track and horizontal track are located on the inside of said cap member and the protrusion is located on the outside of the top portion of said elongated tubular body and said cap member and said elongated tubular body are telescopically interconnected by said cap member being fitted over the top portion of said elongated tubular body.

4. The childproof dispenser of claim 1 wherein said elongated tubular body has a circular cross section.

* * * * *